US005195210A

United States Patent [19]

Lee

[11] Patent Number: 5,195,210

[45] Date of Patent: Mar. 23, 1993

[54] HYDRAULIC DOOR HINGE

[76] Inventor: Simpson Lee, No. 11, Lane 184, Chung-Hsiao Rd., Pingtung, Taiwan

[21] Appl. No.: 901,848

[22] Filed: Jun. 19, 1992

[51] Int. Cl.[5] ..... E05F 3/20; E05D 7/00

[52] U.S. Cl. ..... 16/54; 16/354

[58] Field of Search ..... 16/54, 354

[56] References Cited

U.S. PATENT DOCUMENTS 1,241,082 9/1917 Bommer ..... 16/54

1,595,723 8/1926 Norton ..... 16/354

*Primary Examiner*—Robert L. Spruill

*Assistant Examiner*—Carmine Cuda

*Attorney, Agent, or Firm*—Charles E. Pfund

[57] ABSTRACT

A door hinge includes a hydraulic retarding device for cushioning the closing action of a door. The hydraulic retarding device has a cylinder body which confines a fluid operating space to receive hydraulic fluid therein. The fluid operating space includes a pair of longitudinally extending cylindrical spaces and an intermediate longitudinal passage provided between and communicating the cylindrical spaces. A vane unit is provided in each of the cylindrical spaces and has a blade which defines a longitudinal clearance with an inner surface of the cylinder body. A baffle extends longitudinally into each of the cylindrical spaces and is disposed between the passage and a respective one of the vane units. The baffles are substantially arc-shaped in cross-section and face away from each other. A gate valve is provided in the passage between the baffles. The vane units are operably associated with the door movement so as to open the gate valve to permit the hydraulic fluid to flow through the passage during a door opening action and so as to close the gate valve to prevent the hydraulic fluid from flowing through the passage and to permit the hydraulic fluid to flow only through the clearance between the vane units and the inner surface of the cylinder body in order to retard the movement of the vane units during a door closing action.

13 Claims, 6 Drawing Sheets

HYDRAULIC DOOR HINGE

BACKGROUND OF THE INVENTION

1. Field of the Invention

The invention relates to a door hinge, more particularly to a hydraulic door hinge which is capable of cushioning the closing action of a door while providing little resistance to a door opening movement.

2. Description of the Related Art

Hydraulic door hinges which are capable of cushioning the closing action of a door are known in the art. However, conventional hydraulic door hinges resist the opening movement of the door, thus making it inconvenient to open the same.

SUMMARY OF THE INVENTION

Therefore, the objective of the present invention is to provide a hydraulic door hinge which is capable of cushioning the closing action of a door while providing little resistance, if any, to a door opening movement.

Accordingly, the preferred embodiment of a hydraulic door hinge of the present invention comprises:

a hinge pin;

a stationary hinge leaf fixed to the hinge pin and adapted to be fixed to a door frame;

a rotatable hinge leaf rotatably mounted to the hinge pin and adapted to be fixed to a door;

a torsion spring assembly mounted on the hinge pin and being wound when the door is moved from a closed position to an open position relative to the door frame so as to provide a force for automatically returning the door back to the closed position;

a transmission unit including: a static gear mounted axially and being stationary relative to the hinge pin; a first gear means meshing with the static gear and rotating in a first direction relative to the static gear when the door moves toward the open position and in a second direction when the door moves toward the closed position; and a second gear means meshing with the first gear means and rotating in a direction opposite to the first gear means; and a hydraulic retarding device including: a cylinder body which confines a fluid operating space to receive hydraulic fluid therein, said fluid operating space including first and second longitudinally extending cylindrical spaces and an intermediate longitudinal passage provided between and communicating the cylindrical spaces; a first gear axle extending axially into the first cylindrical space and rotating with the second gear means; a second gear axle extending axially into the second cylindrical space; a third gear means provided on and rotating with the first gear axle; a fourth gear means provided on the second gear axle and meshing with the third gear means so as to rotate the second gear axle in a direction opposite to the first gear axle; a pair of vane units, each of the vane units being provided in a respective one of the cylindrical spaces and having a tubular portion which engages and which rotates with a respective one of the first and second gear axles, each of the vane units further having a blade which extends radially outward from the respective one of the first and second gear axles and which defines a longitudinal clearance with an inner surface of the cylinder body; a pair of baffles which extend longitudinally into a respective one of the first and second cylindrical spaces, each of the baffles being disposed between the passage and a respective one of the vane units, said baffles being substantially arc-shaped in cross-section and facing away from each other; and a gate valve means provided in the passage between the baffles;

rotation of the first gear means in the first direction causing the vane units to direct the hydraulic fluid towards one side of the gate valve means to open the gate valve means and permit the hydraulic fluid to flow through the passage when the door moves toward the open position;

rotation of the first gear means in the second direction causing the vane units to direct the hydraulic fluid towards the other side of the gate valve means to close the gate valve means, thereby preventing the hydraulic fluid from flowing through the passage and permitting the hydraulic fluid to flow only through the clearance between the vane units and the inner surface of the cylinder body in order to retard the movement of the vane units when the door moves toward the closed position.

BRIEF DESCRIPTION OF THE DRAWINGS

Other features and advantages of the present invention will become apparent in the following detailed description of the preferred embodiments, with reference to the accompanying drawings, of which.

DETAILED DESCRIPTION OF THE PREFERRED EMBODIMENTS

Figure 1A:
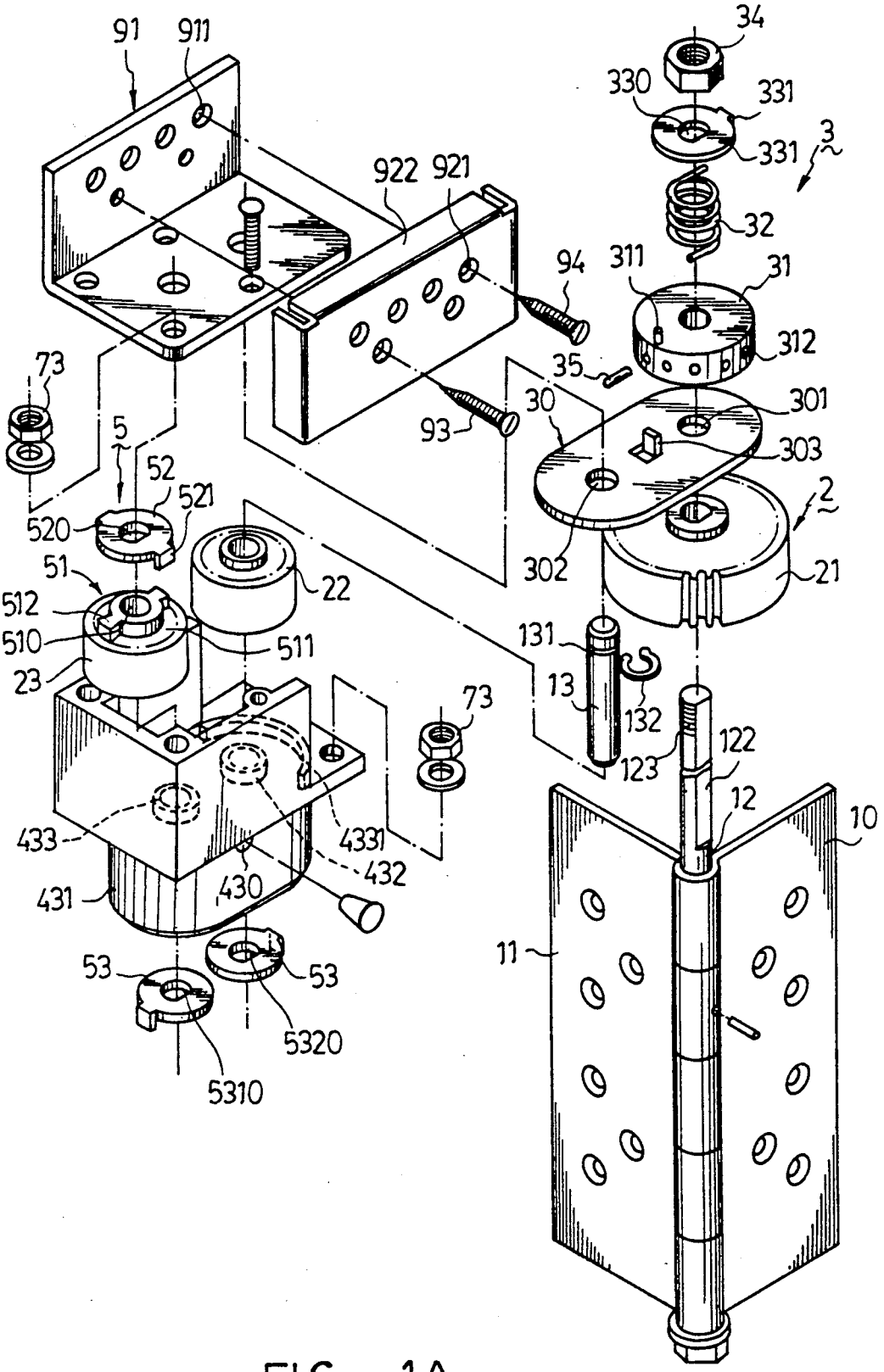
FIGS. 1A and 1B are fragmentary exploded views of the preferred embodiment of a door hinge according to the present invention.
Figure 1B:
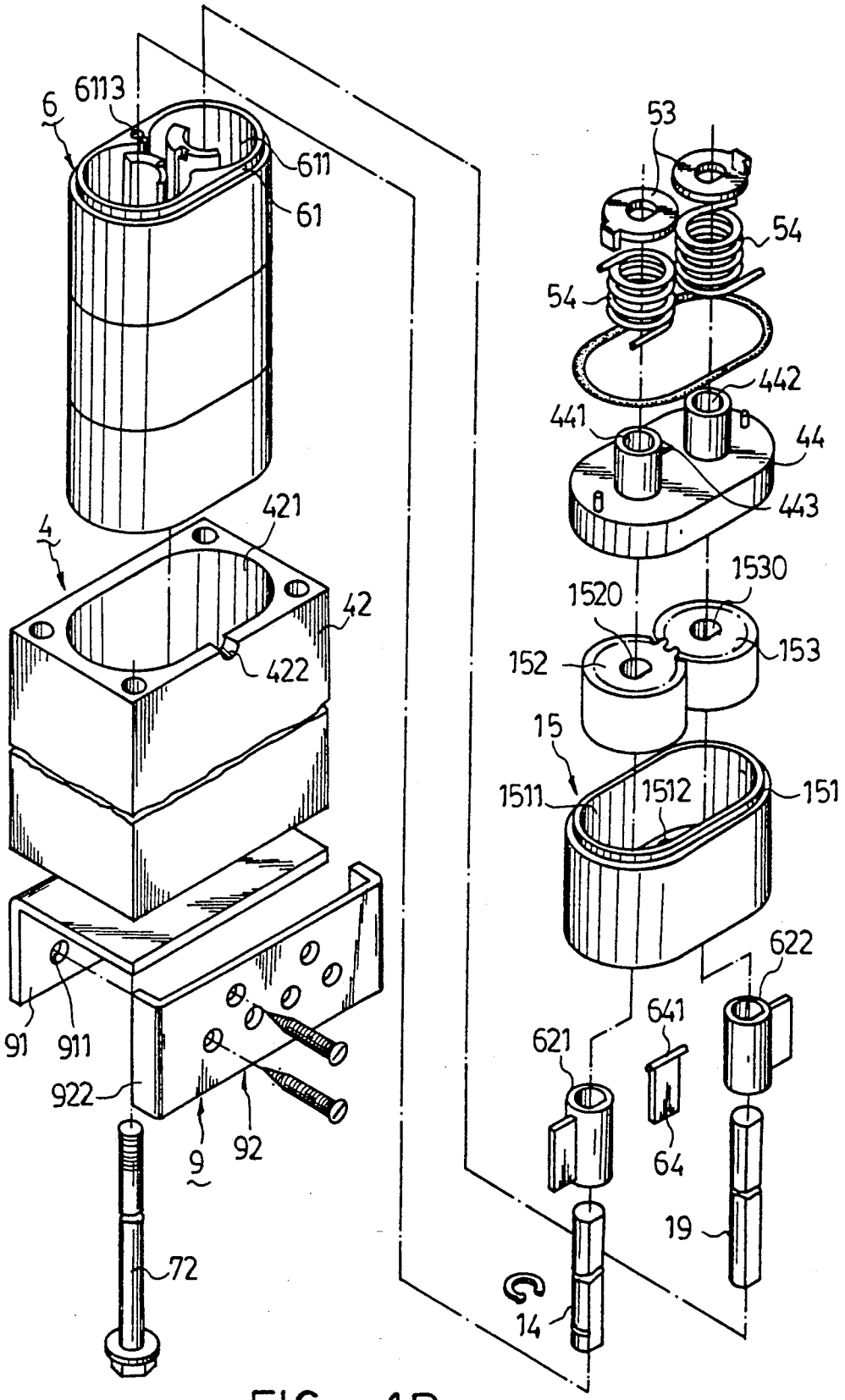
Figure 2:
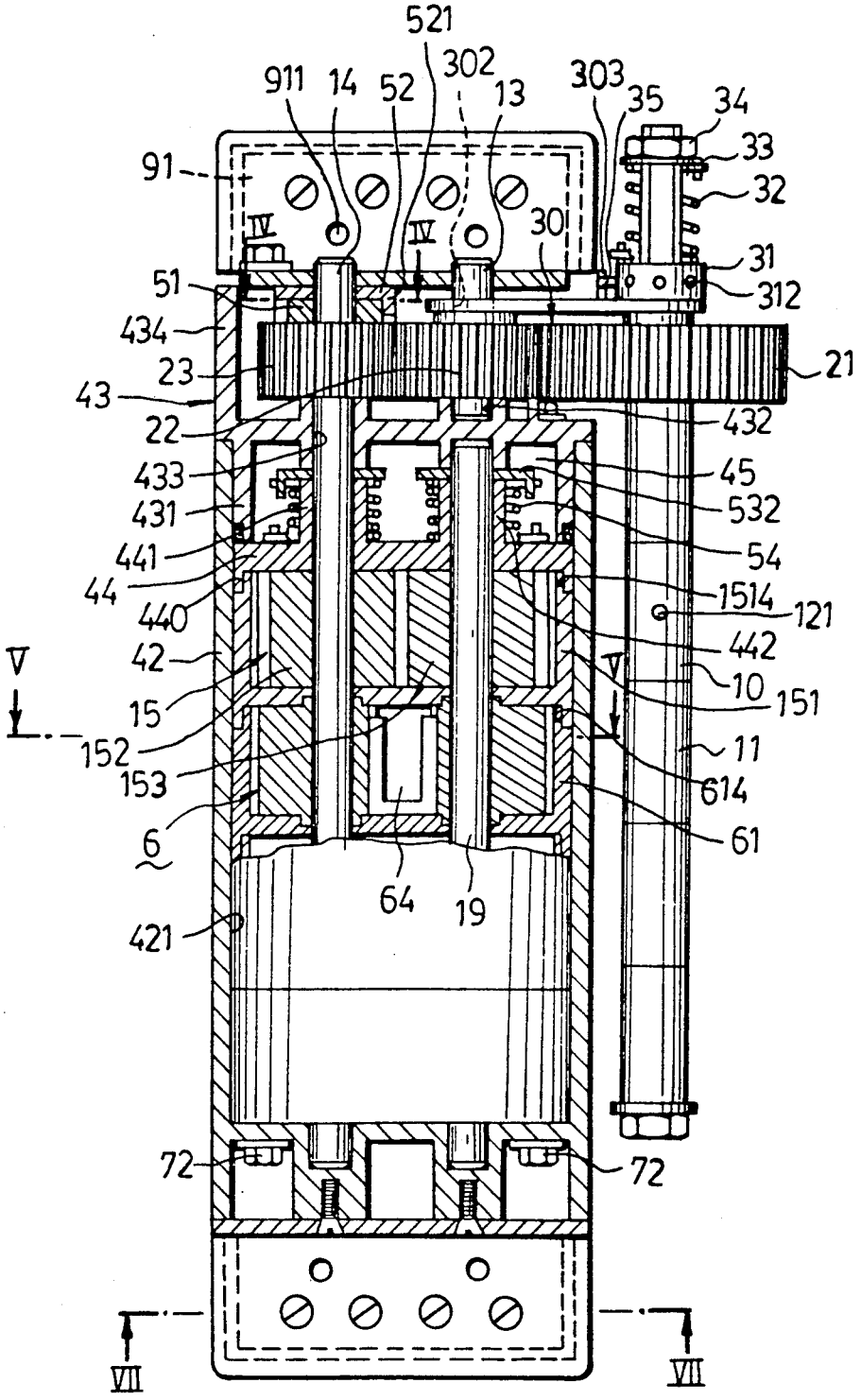
FIG. 2 is an illustration of the preferred embodiment showing its assembly.
Figure 3:
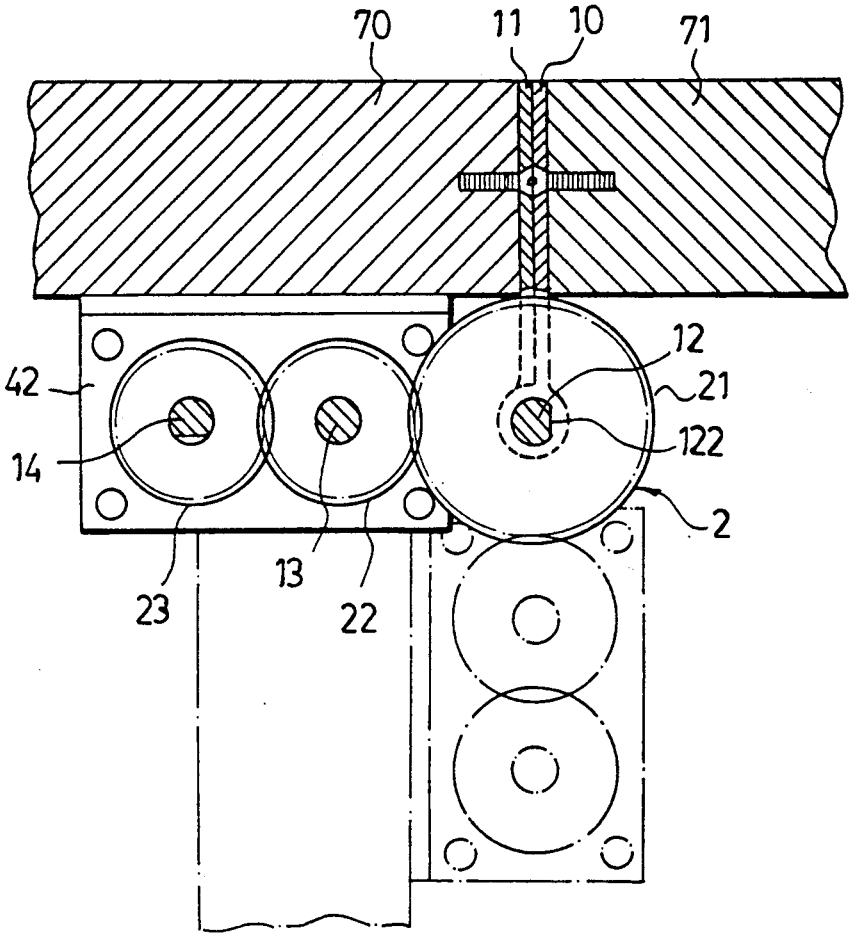
FIG. 3 is a top view of the preferred embodiment when mounted on a door and door frame.

Referring to FIGS. 1A, 1B, 2 and 3, the preferred embodiment of a hydraulic door hinge according to the present invention is shown to comprise a stationary hinge leaf (10), a rotatable hinge leaf (11), a hinge pin (12), a transmission unit (2), a torsion spring assembly (3), a housing unit (4), a gear assembly (15), a first gear axle (13), a second gear axle (14), a third gear axle (19), a linking-up unit (5), a hydraulic retarding device (6) and a pair of mounting units (9).

The hinge leaves (10, 11) have knuckles which are joined together by the hinge pin (12). The stationary hinge leaf (10) is secured on a door frame (71), while the rotatable hinge leaf (Il) is secured on a door (70). An engaging pin (121) is used to fasten one of the knuckles of the hinge leaf (10) to the hinge pin (12), thereby preventing the rotation of the hinge leaf (10) relative to the hinge pin (12). The upper end portion (122) of the hinge pin (12) has a cross-section which is shaped as a circular segment and further has external screw threads (123) formed thereon.

The transmission unit (2) includes a static gear (21) and first and second driven gears (22, 23). The static gear (21) is provided with a central hole (211) which has a size and shape that corresponds to the cross-section of the upper end portion (121) of the hinge pin (12). The static gear (21) is provided on the upper end portion (121) and is therefore stationary relative to the hinge pin (12). The first and second driven gears (22, 23) mesh with the static gear (21).

The torsion spring assembly (3) is provided on the upper end portion (121) of the hinge pin (12) and comprises a horizontally extending support panel (30), a rotatable collar (31), a torsion spring (32), a stationary collar (33), a nut (34) and a control pin (35). The support panel (30) is formed with a pair of spaced openings (301, 302). The upper end portion (121) of the hinge pin (12) passes through the opening (301). The support panel (30) is further provided with an upright projection (303) adjacent to the opening (301). The rotatable collar (31) is provided on top of the support panel (30) and is a cylindrical body which is formed with an upright through bore (310) for receiving the upper end portion (121) therethrough. The rotatable collar (31) further has a top side provided with an eccentric upright projection (311) and a plurality of radially extending and angularly spaced bores (312). The torsion spring (32) surrounds the upper end portion (121) and has a lower end secured to the upright projection (311). The stationary collar (33) is formed with a central hole (330) which has a size and shape that corresponds to the cross-section of the upper end portion (121) and is provided on the upper end portion (121) on top of the torsion spring (12). The upper end of the torsion spring (32) is secured on a downwardly extending projection (331) which is formed on the stationary collar (33). The nut (34) engages the external screw threads (123) of the upper end portion (121) so as to retain the collars (31 33) and the torsion spring (32) thereat. The control pin (35) is inserted into a selected one of the bores (312). The torsion spring assembly (3) provides the force required to close the door when the door is opened, as will be detailed in the succeeding paragraphs. The force of the torsion spring assembly (3) can be varied by varying the position of the control pin (35) relative to the bores (312).

The housing unit (4) includes a cylinder housing (42) and a gear support (43) which covers an open top end of the cylinder housing (42). The cylinder housing (42) confines a receiving space (421) and is formed with a fluid inlet (422). A cylinder body (61) of the hydraulic retarding device (6) is provided inside the receiving space (421). A gear housing (151) of the gear assembly (15) is provided on top of the cylinder body (61) inside the receiving space (421). A bolt (72) and a nut (73) are used to join together the cylinder housing (42) and the gear support (43) so as to retain the gear assembly (15) and the hydraulic retarding device (6) in the housing unit (4). The cylinder body (61) has an open top end which is formed with a peripheral groove (614). The gear housing (151) has a downward peripheral lip (1513) formed on a bottom side thereof and received in the peripheral groove (614) so as to engage the gear housing (151) and the cylinder body (61). A cover panel (44) is provided on an open top end of the gear housing (151). The top end of the gear housing (151) is formed with a peripheral groove (1514) that receives a peripheral downward lip (440) of the cover panel (44), thereby securing the cover panel (44) onto the gear housing (151). The cover panel (44) is further formed with a pair of spaced upwardly extending tubular shafts (441, 442) and an access opening (443) to access the gear housing (151).

The gear support (43) has a downwardly extending tubular portion (431) which extends into the receiving space (421) and which abuts the periphery of the cover panel (44). The gear support (43) and the cover panel (44) cooperatively define a chamber (45) therebetween. The tubular portion (431) is formed with an opening (430) which is aligned with the fluid inlet (422). The gear support (43) is further formed with upper and lower axle seats (432) which are aligned with the tubular shaft (442) and a axle opening (433) which is aligned with the tubular shaft (441). The gear support (43) further has an upright wall portion (434) and a raised barrier (4331) formed adjacent to a top end of the tubular portion (431) to prevent hydraulic fluid which may leak through the axle opening (433) from spilling out of the gear support (43).

The first axle (13) has a lower end received in the upper axle seat (432) on the gear support (43) and an upper end extending axially through the first driven gear (22) and the opening (302) in the support panel (30). The upper end of the first axle (13) is formed with a peripheral groove (131) which receives a C-shaped locking ring (132) for retaining the first driven gear (22) between the gear support (43) and the support panel (30).

The second axle (14) is a circular segment in cross-section and extends through the axle opening (433) in the gear support (43) and into the tubular shaft (441) of the cover panel (44) and the cylinder body (61). The lower end of the second axle (14) is rotatably mounted on the bottom of the cylinder housing (42). The upper end of the second axle (14) extends axially through the second driven gear (23).

The third axle (19) is similarly a circular segment in cross-section and has an upper end received in the lower axle seat (432) on the gear support (43) and a lower end which extends into the tubular shaft (442) of the cover panel (44) and into the cylinder body (61). The lower end of the second axle (14) is similarly rotatably mounted on the bottom of the cylinder housing (42).

The gear housing (151) confines a hollow operating space (1511). The gear assembly (15) further comprises a pair of meshed gears (152, 153) provided in the operating space (1511). The second axle (14) extends axially through a central hole (1520) of the gear (152), while the third axle extends axially through a central hole (1530) of the gear (153). The sizes and shapes of the central holes (1520, 1530) correspond with the cross-sections of the second and third axles (14, 19) to permit the gears (152, 153) to rotate with the second and third axles (14, 19). Note that the gears (152, 153) rotate in opposite directions, thereby causing the second and third axles (14, 19) to rotate similarly in opposite directions. The bottom of the gear housing (151) is further formed with an access opening (1512) to access the cylinder body (61).

Figure 4:
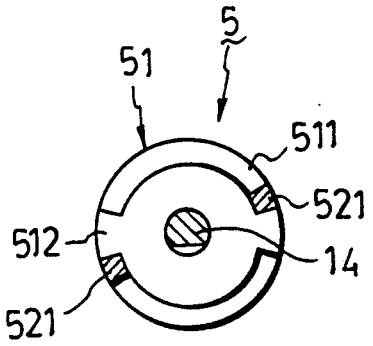
FIG. 4 is a IV—IV section of FIG. 2.
Figure 5:
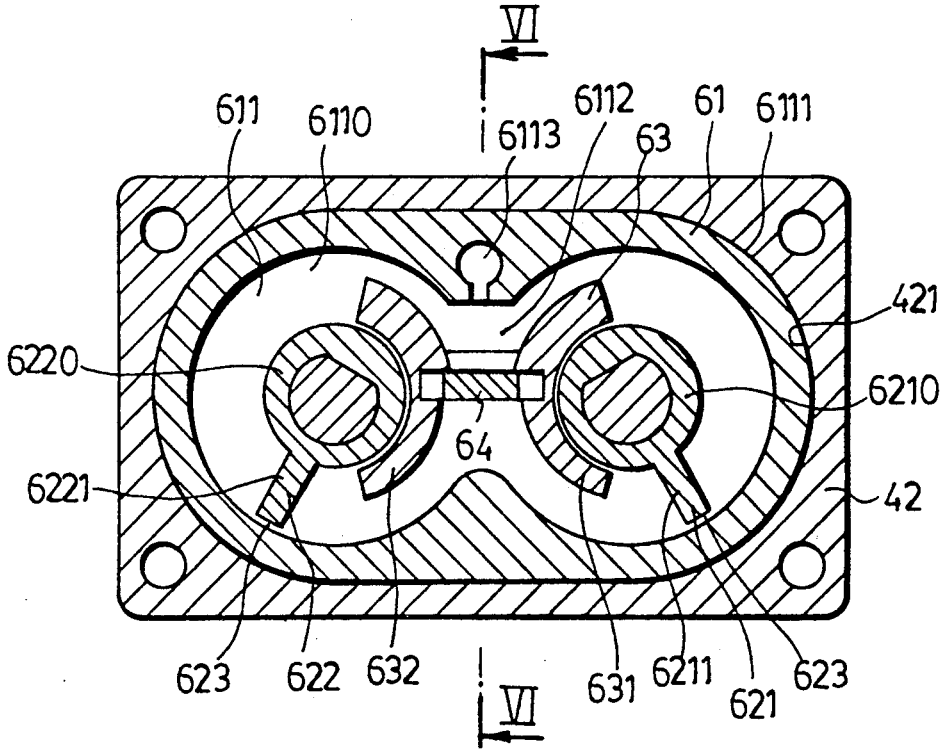
FIG. 5 is a top view of a hydraulic retarding device of the preferred embodiment.
Figure 6:
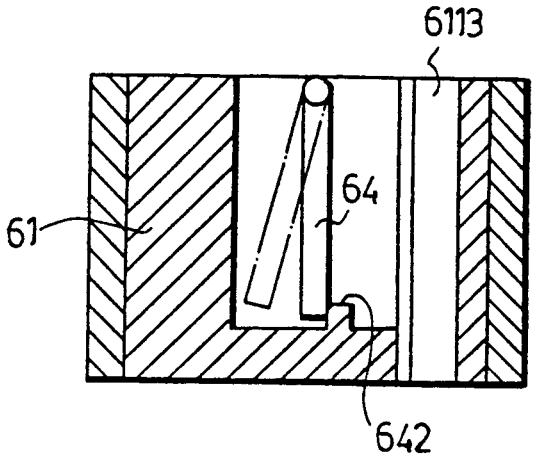
FIG. 6 is a VI—VI section of FIG. 5.
Figure 7:
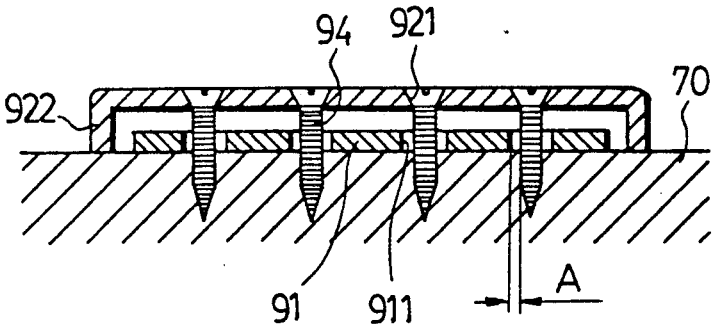
FIG. 7 is a VII—VII section of FIG. 2.

The linking-up unit (5) comprises a rotary plate (51), a first linking-up plate (52), second and third linking-up plates (531, 532) and a pair of torsion springs (54). In the preferred embodiment, the rotary plate (51) is integrally formed on a top side of the second driven gear (23). The rotary plate (51) is provided with a pair of opposite arcuate tracks (511), a pair of upright track end projections (512) and a central hole (510) to permit the second axle (14) to pass therethrough. The first and second linking-up plates (52, 531) are respectively formed with a central hole (520, 5310) that is shaped as a circular segment so as to engage the second axle (14). The third linking-up plate (532) is similarly formed with a central hole (5320) that is shaped as a circular segment so as to engage the third axle (19). The first linking-up plate (52)

is provided on top of the rotary plate (51) and has a pair of flanges (521) which extend downwardly into a respective one of the tracks (511). The linking-up plates (531, 532) are provided inside the chamber (45) on top of a respective one of the tubular shafts (441, 442). Each of the torsion springs (54) is provided around a respective one of the tubular shafts (441, 442) between the linking-up plates (531, 532) and the cover panel (44). Each of the torsion springs (54) has a lower end which engages the cover panel (44) and an upper end which engages a respective one of the linking-up plates (531, 532). The torsion springs (54) bias the second and third axles (14, 19) such that the flanges (521) of the first linking-up plate (52) abut against the track end projections (512) on the rotary plate (51), as shown in FIG. 4.

Because the second and third axles (14, 19) rotate simultaneously in opposite directions, the linking-up plates (531, 532) similarly rotate simultaneously in opposite directions. The torsion springs (54) should therefore be oriented in opposing directions so as to be simultaneously wound or unwound.

Referring to FIGS. 1A, 1B, 5 and 6, the cylinder body (61) of the hydraulic retarding device (6) is provided inside the receiving space (421) of the cylinder housing (42). In the preferred embodiment, a plurality of hydraulic retarding devices (6) are installed inside the receiving space (421) of the cylinder housing (42). The cylinder bodies (61) of the hydraulic retarding devices (6) are stacked on top of one another. The number of hydraulic retarding devices (6) installed depend upon the required amount of retarding force to be applied on the door (70). Each of the hydraulic retarding devices (6) further comprises a pair of vane units (621, 622), a baffle means (63) and a gate (64).

The cylinder body (61) confines a fluid operating space (611) which includes first and second longitudinally extending cylindrical spaces (6110, 6111) and an intermediate longitudinal passage (6112) provided between and communicating the cylindrical spaces (6110, 6111). The cylinder body (61) is further formed with a longitudinally extending notch (6113) to communicate the operating space (611) with the cylinder bodies (61) of the other hydraulic retarding devices (6). Hydraulic fluid (52) which is introduced via the fluid inlet (422) of the cylinder housing (42) flows into the chamber (45), through the operating space (1511) of the gear housing (151) via the access opening (443) in the cover panel (44), and into the notch (6113) and the operating space (611) in the cylinder bodies (61) via the access opening (1512) in the gear housing (151). The second and third axles (14, 19) respectively extend into the cylindrical spaces (6110, 6111). Each of the vane units (621, 622) is provided in a respective one of the cylindrical spaces (6110, 6220) and has a tubular portion (6210, 6220) which engages and which rotates with a respective one of the second and third axles (14, 19). Each of the vane units (621, 622) further has a blade (6211, 6221) which extends radially outward from a respective one of the second and third axles (14, 19) and which defines a longitudinal clearance (623) with the inner surface of the cylinder body (61).

The baffle means (63) includes a pair of baffles (631, 632) which extend longitudinally into a respective one of the cylindrical spaces (6110, 6111). Each of the baffles (631, 632) is disposed between the passage (6112) and a respective one of the vane units (621, 622). The baffles (631, 632) are substantially other. arc-shaped in cross-section and face away from each Finally, the gate (64) is provided in the passage (6112) between the baffles (631, 632). The gate (64) has a horizontal lug portion (641) which has two ends pivoted on the baffles (631, 632) at the upper ends of the latter. A valve seat (642) extends upwardly from the bottom of the cylinder body (61) and into the passage (6112). The vane units (621, 622) are operated so as to move the gate (64) toward or away from the valve seat (642), as will be detailed in the succeeding paragraphs.

Referring to FIGS. 1A to 6, when the door (70) is moved from a closed position to an open position relative to the door frame (70), the upright projection (303) on the support panel (30) urges the control pin (35) so as to rotate the rotatable collar (31) relative to the stationary collar (33), thereby winding the torsion spring (32) in order to generate the force which is required to move the door (70) back to the closed position. The opening action of the door (70) causes the first driven gear (22) to rotate in a counterclockwise direction relative to the static gear (21), thereby rotatably driving the second driven gear (23) in a clockwise direction. The rotary plate (51) rotates with the second driven gear (23), thereby causing the torsion springs (54) to unwind and rotate the second linking-up plate (531), the second axle (14) and the first linking-up plate (52) in a clockwise direction to press the flanges (521) on the first linking-up plate (52) against the track end projections (512) on the rotary plate (51).

Clockwise rotation of the second axle (14) causes the gear (152) to rotate similarly in a clockwise direction and drive the gear (153) to rotate in a counterclockwise direction. Counterclockwise rotation of the gear (153) causes the third axle (19) to rotate in the same direction.

The vane units (621, 622) rotate with the second and third axles (14, 19). Therefore, when the door (70) moves from the closed position to the open position, the vane unit (621) rotates in a counterclockwise direction, while the vane unit (622) rotates in a clockwise direction. The vane units (621, 622) urge the hydraulic fluid (52) inside the operating space (611) to push the gate (64) away from the valve seat (642), as shown in FIG. 8, thereby permitting the hydraulic fluid (52) to flow through the passage (6112). The hydraulic retarding device (6) therefore exerts little #resistance, if any, when the door (70) is opened.

When the force which was applied so as to open the door (70) has been removed, the torsion spring (32) unwinds to close the door (70). The closing action of the door (70) causes the first driven gear (22) to rotate in a clockwise direction relative to the static gear (21), thereby rotatably driving the second driven gear (23) in a counterclockwise direction. The rotary plate (51) rotates with the second driven gear (23), thereby causing the torsion springs (54) to wind and to rotate the second linking-up plate (531), the second axle (14) and the first linking-up plate (52) in a counterclockwise direction. Counterclockwise rotation of the second axle (14) causes the gears (152, 153) to rotate and drive the third axle (19) to rotate in a clockwise direction. Therefore, when the door (70) moves from the open position to the closed position, the vane unit (621) rotates in a clockwise direction, while the vane unit (622) rotates in a counterclockwise direction. The vane units (621, 622) urge the hydraulic fluid (52) inside the operating space (611) to push the gate (64) toward the valve seat (642), thereby preventing the flow of hydraulic fluid (52) through the passage (6112). Fluid flow only occurs at the clearance (623) between the vane units (621, 622)

and the inner surface of the cylinder body (61). The rotation of the vane units (621, 622) is therefore retarded to retard correspondingly the rotation of the second and third axles (14, 19) and the first and second driven gears (22, 23), thereby resulting in the cushioning of the closing action of the door (70) to prevent slamming.

Referring to FIGS. 1A, 1B, 2 and 7, the mounting units (9) are used to secure the preferred embodiment on the door (70). The mounting units (9) guard against the improper operation of the preferred embodiment caused by misalignment between the static gear (21) and the driven gear (22) when the preferred embodiment is installed.

Each of the mounting units (9) includes first and second mounting panels (91, 92). The first mounting panel (91) of one of the mounting units (9) is secured to the upright wall portion (434) of the gear support (43), while the first mounting panel (91) of the other one of the mounting units (9) is secured to the bottom of the cylinder housing (42) The first mounting panel (91) is provided with a plurality of openings (911). The second mounting panel (92) is similarly formed with a plurality of openings (921) which are aligned with and which are smaller than the openings (911) in the first mounting panel (91). The second mounting panel (92) is provided with a rearward peripheral flange (922) to space apart the first and second mounting panels (91, 92). Screws (93) are initially used so as to secure the first and second mounting panels (91, 92) onto the door (70). The openings (911, 921) in the first and second mounting panels (91, 92) are aligned at this stage. Screws (94) then extend into the openings (911, 921), and the screws (93) are removed. Because of the difference in the sizes of the openings (911, 921), a gap (A) is formed between the screws (94) and the respective opening (911). The gap (A) permits slight movement of the first mounting panel (91) relative to the second mounting panel (92) so as to facilitate proper alignment between the static gear (13) and the driven gear (22) when the preferred embodiment is installed.

Note that in the preferred embodiment, the force of the torsion spring assembly (3) is varied by varying the position of the control pin (35) relative to the bores (312). Varying the diameters of the static gear (21) and the first and second driven gears (22, 23) can also be effected to vary the spring force of the torsion spring assembly (3).

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A hydraulic door hinge, comprising:

a hinge pin;

a stationary hinge leaf fixed to said hinge pin and adapted to be fixed to a door frame;

a rotatable hinge leaf rotatably mounted to said hinge pin and adapted to be fixed to a door;

a torsion spring assembly mounted on said hinge pin and being wound when the door is moved from a closed position to an open position relative to the door frame so as to provide a force for automatically returning the door back to the closed position;

a transmission unit including: a static gear mounted axially and being stationary relative to said hinge pin; a first gear means meshing with said static gear and rotating in a first direction relative to said static gear when the door moves toward the open position and in a second direction when the door moves toward the closed position; and a second gear means meshing with said first gear means and rotating in a direction opposite to said first gear means; and a hydraulic retarding device including: a cylinder body which confines a fluid operating space to receive hydraulic fluid therein, said fluid operating space including first and second longitudinally extending cylindrical spaces and an intermediate longitudinal passage provided between and communicating said cylindrical spaces; a first gear axle extending axially into said first cylindrical space and rotating with said second gear means; a second gear axle extending axially into said second cylindrical space; a third gear means provided on and rotating with said first gear axle; a fourth gear means provided on said second gear axle and meshing with said third gear means so as to rotate said second gear axle in a direction opposite to said first gear axle; a pair of vane units, each of said vane units being provided in a respective one of said cylindrical spaces and having a tubular portion which engages and which rotates with a respective one of said first and second gear axles, each of said vane units further having a blade which extends radially outward from the respective one of said first and second gear axles and which defines a longitudinal clearance with an inner surface of said cylinder body; a pair of baffles which extend longitudinally into a respective one of said first and second cylindrical spaces, each of said baffles being disposed between said passage and a respective one of said vane units, said baffles being substantially arc-shaped in cross-section and facing away from each other; and a gate valve means provided in said passage between said baffles;

rotation of said first gear means in the first direction causing said vane units to direct said hydraulic fluid towards one side of said gate valve means to open said gate valve means and permit said hydraulic fluid to flow through said passage when the door moves toward the open position;

rotation of said first gear means in the second direction causing said vane units to direct said hydraulic fluid towards the other side of said gate valve means to close said gate valve means, thereby preventing said hydraulic fluid from flowing through said passage and permitting said hydraulic fluid to flow only through said clearance between said vane units and the inner surface of said cylinder body in order to retard the movement of said vane units when the door moves toward the closed position.

2. The hydraulic door hinge as claimed in claim 1, wherein said torsion spring assembly comprises:

a horizontally extending support panel rotating with the door and formed with an opening to permit said hinge pin to extend therethrough;

a rotatable collar mounted axially on said hinge pin and rotating with said support panel relative to said hinge pin when the door is moved;

a stationary collar mounted axially on said hinge pin and being stationary relative to said hinge pin; and a torsion spring surrounding a portion of said hinge pin between said stationary and rotatable collars, said torsion spring having a first end connected to said stationary collar and a second end connected to said rotatable collar; whereby, said torsion spring is wound when said support panel and said rotatable collar move with the door away from the closed position.

3. The hydraulic door hinge as claimed in claim 2, wherein:

said rotatable collar is a cylindrical body which is formed with a plurality of radially extending and angularly spaced bores;

said support panel is provided with an upright projection adjacent to said rotatable collar; and said torsion spring assembly further comprises a control pin which is inserted into one of said bores and which abuts said upright projection to permit winding of said torsion spring when the door moves away from the closed position.

4. The hydraulic door hinge as claimed in claim 1, further comprising a housing unit adapted to be mounted to the door and including: a cylinder housing which receives said cylinder body therein; a gear housing provided inside said cylinder housing on top of said cylinder body and having an open top end, said third and fourth gear means being provided inside said gear housing; a cover panel provided inside said cylinder housing to cover said open top end of said gear housing, said cover panel being formed with a pair of spaced upwardly extending tubular shafts to permit said first and second gear axles to extend into and through said gear housing; and a gear support having a downwardly extending tubular portion which extends into said cylinder housing and which abuts the periphery of said cover panel, said first and second gear means being provided on top of said gear support, said gear support further having an axle opening to permit said first gear axle to extend therethrough.

5. The hydraulic door hinge as claimed in claim 4, further comprising a linking-up unit which includes:

an upright projection formed on a top side of said second gear means;

a first linking-up plate mounted axially on said first gear axle on top of said second gear means, said first linking-up plate rotating with said first gear axle and having a downwardly extending flange;

a second linking-up plate provided inside said housing unit between said cover panel and said gear support, said second linking-up plate being provided on top of one of said tubular shafts of said cover panel and being mounted axially on and rotating with said first gear axle; and a first torsion spring provided around said one of said tubular shafts and having a first end which engages said cover panel and a second end which engages said second linking-up plate, said first torsion spring biasing said first gear axle such that said flange on said first linking-up plate abuts said upright projection on said second gear means.

6. The hydraulic door hinge as claimed in claim 5, wherein said linking-up unit further comprises:

a third linking-up plate similarly provided inside said housing unit between said cover panel and said gear support, said third linking-up plate being provided on top of the other one of said tubular shafts and being mounted axially on and rotating with said second gear axle; and a second torsion spring provided around said other one of said tubular shafts and having a lower end which engages said cover panel and an upper end which engages said third linking-up plate, said first and second torsion springs being oriented in opposite directions so as to wind or unwind simultaneously.

7. The hydraulic door hinge as claimed in claim 1, further comprising a mounting unit for securing said housing unit to the door, said mounting unit including:

a first mounting panel provided with a row of openings and connected to said housing unit;

a second mounting panel spaced from a front side of said first mounting panel and similarly provided with a row of openings which are aligned with and which are smaller than said openings in said first mounting panel; and screws extending into aligned said openings in said first and second mounting panels to fasten said first and second mounting panels to the door.

8. The hydraulic door hinge as claimed in claim 7, wherein said gear support has an upright wall portion, said first mounting panel being connected to said upright wall portion.

9. The hydraulic door hinge as claimed in claim 1, wherein said gate valve means comprises:

a valve seat extending upwardly into said passage from a bottom side of said cylinder body; and a gate provided in said passage and having a horizontal lug portion which extends between said baffles and which is pivoted to upper ends of said baffles.

10. The hydraulic door hinge as claimed in claim 4, wherein said open top end of said gear housing is formed with a peripheral groove, said cover panel having a peripheral downward lip received in said peripheral groove.

11. The hydraulic door hinge as claimed in claim 4, wherein said cylinder body has an open top end which is formed with a peripheral groove, said gear housing having a peripheral downward lip received in said peripheral groove.

12. The hydraulic door hinge as claimed in claim 4, wherein:

said cylinder housing is formed with a fluid inlet;

said tubular portion of said gear support is formed with an opening which is aligned with said fluid inlet;

said cover panel is formed with an access opening to access said gear housing; and said gear housing has a bottom which is formed with an access opening to access said hydraulic retarding device.

13. The hydraulic door hinge as claimed in claim 12, further comprising a plurality of said hydraulic retarding devices received in said cylinder housing, said cylinder bodies of said hydraulic retarding devices being stacked on top of each other and being formed with aligned longitudinally extending notches.

* * * * *